US009284828B2

(12) United States Patent
Linetskiy et al.

(10) Patent No.: US 9,284,828 B2
(45) Date of Patent: Mar. 15, 2016

(54) METHOD FOR INCREASING HYDROCARBON EXTRACTION AND FOR ENSURING THE CONTINUOUS OPERATION OF WELLS

(71) Applicant: Alexander Petrovich Linetskiy, St. Petersburg (RU)

(72) Inventors: Alexander Petrovich Linetskiy, St. Petersburg (RU); Valeriy Michailovich Volynkin, St. Petersburg (RU)

(73) Assignee: Alexander Petrovich Linetskiy (RU)

( * ) Notice: Subject to any disclaimer, the term of this patent is extended or adjusted under 35 U.S.C. 154(b) by 68 days.

(21) Appl. No.: 14/352,274

(22) PCT Filed: Apr. 5, 2013

(86) PCT No.: PCT/RU2013/000313
§ 371 (c)(1),
(2) Date: Apr. 16, 2014

(87) PCT Pub. No.: WO2013/154468
PCT Pub. Date: Oct. 17, 2013

(65) Prior Publication Data

US 2014/0251606 A1 Sep. 11, 2014

(30) Foreign Application Priority Data

Apr. 12, 2012 (RU) ..... 2012114259

(51) Int. Cl.
*E21B 43/16* (2006.01)
*E21B 43/25* (2006.01)
*E21B 43/26* (2006.01)
*E21B 37/06* (2006.01)

(52) U.S. Cl.
CPC ..... *E21B 43/25* (2013.01); *E21B 37/06* (2013.01); *E21B 43/16* (2013.01)

(58) Field of Classification Search
CPC ..... E21B 43/281; E21B 43/04; E21B 43/25; E21B 21/068; E21B 43/26; E21B 43/267; E21B 21/003; E21B 41/0064; E21B 43/14; E21B 43/16
See application file for complete search history.

(56) References Cited

U.S. PATENT DOCUMENTS 4,421,656 A * 12/1983 Donatelli ..... B01F 17/0071 507/127

* cited by examiner

*Primary Examiner* — Zakiya W Bates
(74) *Attorney, Agent, or Firm* — St Onge Steward Johnson and Reens LLC

(57) ABSTRACT

A method for increasing extraction of oil, gas and gas condensates from deposits includes the steps of pumping a working fluid into a well, wherein the working fluid is an organic solvent comprising at least one aromatic hydrocarbon, at least one carboxylic acid and at least one organic acid, adjusting a density of the working fluid based at least in part on a density of formation fluid, and adjusting a viscosity of the working fluid based at least in part on desired degree of penetration of the working fluid into surrounding formation layers.

3 Claims, 2 Drawing Sheets

METHOD FOR INCREASING HYDROCARBON EXTRACTION AND FOR ENSURING THE CONTINUOUS OPERATION OF WELLS

FIELD OF THE INVENTION

The subject matter generally relates to the mining industry and may be used to increase the extraction of oils, gas condensates and gas from deposits.

BACKGROUND OF THE INVENTION

A method is known for acid-salt treatment of near-mine zone of layers comprising carbonate rocks (see Suchkov B. M. Intensifying Oil Wells Output-Moscow-Izhevsk: Scientific Research Center "Regular and chaotic dynamics," Computer Research Institute, 2007, pp. 145-150), according to which an operational acid-salt solution is pumped into the extraction and injection wells drilled at the deposits. The operational acid-salt solution is a 12-15% or 24-28% solution of acid-salt with additions of surface-active agents, corrosion inhibitors, and acetic acid. The acid-salt solution is kept within the treated layers for some time, wherein the treatment regime is selected according to the following principle; if the permeability of the layer is low, the pressure of solution is increased, and if the depth of the layer is greater, the solution is pumped at a higher speed.

The main disadvantages of the method are:

- the acid solution may be substantially diluted with the layer waters that are almost always present in oil and gas layers;
- once the acid concentration of the operational solution is decreased to a certain level, the secondary residue formation process may start within layers, resulting in formation of non-soluble salts, which block the cracks and pores in layers;
- the method results in uneven activity of the acid solutions on cracks, especially given differences between permeabilities of certain layers and interlayers and presence of large cracks and layer rock continuity breaks. In such circumstances, all of the operational solution goes to the most open interlayer or into the cracks within the continuity break zones, since it is not possible to alter the operational solution viscosity;
- or, in contrast, the method can lead to the above-normal influence of acid solutions of the formations, which results in closing of the cracks, thus reducing filtering of the layers;
- efficiency of recurring treatments decreases and deep layer treatments cannot be carried out multiple times;
- due to high corrosion activity of the operational solution, well equipment and pipes quickly collapse after layer treatment.

A method is also known for oil-acid treatment of near-mine zone of layers. (See Suchkov B. M. Intensifying Oil Wells Output-Moscow-Izhevsk: Scientific Research Center "Regular and chaotic dynamics," Computer Research Institute, 2007, p. 441). In this known method, an operational liquid is a mixture of oil, which acts as a solvent for resin-paraffin sediments, and an acid, which acts as a solvent for salts of carbonate and terrigenous sediments. The operational liquid is formed as an emulsion by adding emulsifier ES-2. This method is efficient only for highly porous layers with visibly expressed discontinuity of layer thickness.

The disadvantages of this method for treatment of near-mine zones of layers include a limited area of use of the method and a very low efficiency in low permeability layers due to high viscosity of operational liquid (emulsion), because its viscosity cannot be altered. Yet another serious disadvantage is the high cost of the emulsifier ES-2 needed to prepare the operational mixture.

Yet another method is known for treating near-mine zones, comprising sediments of hydrocarbon compounds, which is based on use of chemical agents that possess high dissolvability and inhibiting activity on organic sediments with a complex composition having above-normal concentration of asphaltens and resins. (See Suchkov B. M. Intensifying Oil Wells Output-Moscow-Izhevsk: Scientific Research Center "Regular and chaotic dynamics," Computer Research Institute, 2007, pp. 473-474). According to this known method, operation fluids are pumped into extraction and injection wells drilled at the formation to treat near-mine zones and to displace oil from the layers, the wells are repaired and the pipes and the equipment therein are subjected to anti-corrosion treatment, and in low surface temperature conditions, the pipes in upper portions of the sediments are cleaned from asphalt-resin-paraffin sediments. The sediment cleaning agents are based on alkyl-substituted benzene hydrocarbons, such as butylbenzene, benzyl toluene and others, that represent the bulk byproduct of oil production industry. During treatment of deep wells, the mixtures are used that further include, besides the substances specified above, saturated hydrocarbons, for example, stable natural gasoline with 0.1-1.5% w.t. additions of oil-soluble SAA (surface-active agents), i.e. aliphatic amines or compositions of the subset of non-saturated aliphatic acids, such as agent "IKNS AzNIPIneft 72." Concentration of benzene hydrocarbons in mixtures is determined based on a composition of hydrocarbon sediments in near-mine zone of formations and is increased with the content of high molecular asphaltens and resins in the sediments. Solvents of SAA added into mixtures decrease surface tension, disperse asphaltens and resins and facilitate the dissolution process. The compositions used in this method facilitate a better cleaning of near-mine zones of layers from heavy hydrocarbon compositions and slow down subsequent sediment formation. Water solutions of sodium oxide silicates and hydrates with concentration not exceeding 38-45% are used as inhibitor agents. Their effect is based on the adsorption processes in the interphase boundary. Asphaltens and resins disperse by means of inhibiting effect with use of sodium oxide silicates and hydrates.

The method has the following disadvantages:

- it is impossible to change viscosity and density of solvent mixtures, which substantially decreases scope of their use—they can only be used under limited conditions with high temperatures in the bottoms of the wells, which are necessary for intensive dissolution of sediments and are only present at great depths in drilled weds;
- it is impossible to use these solvent mixtures in developed systems of large cracks and layer continuity breaks, as well as after hydraulic fracturing of rock layers, wherein in about 90% of extraction wells, in order to increase rate of inflow of oil and gas, large horizontal and vertical cracks are formed in layers. In such systems, the mixtures will fully filtrate into these large cracks, as well as penetrate into inter layers with good permeability, causing the layers with lower permeability to remain untreated, which will significantly decrease efficiency of treatment of near-mine zones of layers throughout extraction wells and efficiency of injection wells killing due to remaining large area and zones in layers that have not been subjected to oil displacement;

the solvent mixture are very high in cost.

SUMMARY OF THE INVENTION

The method of the present invention presents an improvement of oil and gas production efficiency by treating bottomhole zones of formation layers and concurrent killing of production wells during repair works under all mining and geological oil and gas field conditions encountered, as well as by displacing oil from formation layers via injection wells, which allows for putting the production wells into operation after repair by killing them via a complex organic solvent with adjustable density and viscosity and by concurrent treatment of the bottomhole zones of formation layers with this solvent without requiring additional cleaning of the production wells and development activities to stimulate inflow of oil and gas therein, which allows for a significant cost reduction and time saving for these activities.

The objectives of the present invention are achieved by a method for increasing production of oil, gas condensates and gas from formations and providing a stable operation of production and injection wells, which includes the steps of pumping working fluids into production and injection wells bored in deposits to treat bottomhole zones and to displace oil from formations, repairing the wells, subjecting pipes and equipment disposed in the wells to anti-corrosion treatment, and in the event of low surface temperatures, cleaning pipes in upper parts of the production wells of asphalt, tar and paraffin deposits, wherein the working fluid used is a complex organic solvent with variable viscosity and density, and wherein the bottomhole zones of formations in the production wells are treated and the injection wells are killed and oil is displaced from the formations in the direction of the production wells by using said solvent, wherein the density of said solvent is set at maximum and the viscosity of said solvent is set at minimum, and wherein the production wells are killed during repair with concurrent treatment of the bottomhole zones of the formations by using said solvent, wherein the density of the solvent is set at maximum and the viscosity of said solvent is selection based on degree of fracturing of the rock layers such that height of the complex organic solvent columns created in the wells remains constant and pressure of the columns prevents oil and other formation fluids from entering the wells due to inside layer pressures, wherein, upon completion of repair of the wells, a viscosity of the solvent is reduced by adding corresponding chemical agents until it reaches a value at which the complex organic solvent begins to filter into the formation layers at low speed due to the pressure in the solvent, and then, upon pumping of the solvent into the wells and creation of increased pressure in the well, a speed of solvent filtration into the bottomhole zones increases to dissolve asphalt, tar and paraffin deposits in terrigenous rocks, wherein organic acids present in the complex solvent dissolve calcium and magnesium salts present in carbonate rock formations, wherein injectability of formation layers during killing of the injection wells is increased and inflow of formation waters into the production wells is decreased due to hydrophobization of surfaces of cracks, pores, and capillaries in the formations and displacement of formation waters deeper into the formation layers and water layers during the treatment of bottomhole zones, wherein, in low surface temperature conditions, the pipes in upper portions of production wells are cleaned from asphalt, tar and paraffin deposits by reducing viscosity and density of the complex organic solvent to minimum values and by recirculating the solvent between bottoms of the wells and solvent reservoirs positioned on the surface, wherein the step of treatment of bottomhole zones of the production wells is repeated multiple times with necessary time intervals to maintain production levels of oil and gas from the formations, wherein anti-corrosion agents such as phosphates are added to the complex organic solvent in specified proportions and mining equipment and pipes are repeatedly covered with an anti-corrosion layer during repeated treatment of bottomhole zones, cleaning of pipes from asphalt, tar and paraffin deposits by recirculating the solvent and killing of the injection wells, wherein, in order to extract gas from formation layers having high water content, density of the complex organic solvent is increased to a maximum and viscosity is decreased to a minimum, and the solvent is pumped into the bottomhole zones under a maximum pressure possible for specified mining and geological conditions without breaking continuity of rock formation and destroying layer structure to displace water from clay-sand and other kinds of gas-carrying formation layers to decrease their water content, while increasing strength characteristics and pore pressure of the rock layers and preventing wide-scale outflow of sand, day and other rocky particles from the formation layers into the bottomhole zones by incoming flow of gas and other fluids, which causes formation of plugs in the wells and breakdown of extraction equipment.

The objectives of the present invention are also achieved by the method, wherein the treatment of bottomhole zones of all production wells at the formation is performed concurrently with killing of all injection wells by using the complex organic solvent, wherein the density of the solvent is increased to a maximum and the viscosity of the solvent is decreased to a minimum, wherein cracks and pores in the formation layers are cleaned from asphalt, tar and paraffin deposits and salt deposits by dissolving salty sediments by dissolving them and increasing injectability of the formation layers, wherein maximum possible pump-in pressures of the complex organic solvent are set under given mining and geological conditions of the field development without fracturing of subsurface rock layers and destroying their structure, wherein oil is displaced towards the production wells, wherein alternating volumes of the complex organic solvent and formation layer waters are pumped into the injection wells in a ratio from about 1:1 at the beginning of pumping to about 1:20 at the end of pumping, based on increasing total volume of the composition pumped.

The objectives of the present invention are further achieved by the method, wherein the amount of the complex organic solvent being pumped into the wells is adjusted depending on physical-chemical properties of oil, mining and geological conditions of oil and gas formation layers and technological conditions formation field development.

According to the present invention, the complex organic solvent includes aromatic hydrocarbon derivatives and carboxylic acid esters to dissolve the asphalt, tar and paraffin deposits, as well as organic acids to dissolve salt deposits.

The method is implemented as follows. Vertical, directional and horizontal wells are drilled in a new field formation in oil and gas layer or a multilayer system, wherein the wells are positioned in a certain order and arrangement for optimal influence effect on the formation layers. Alternatively, the existing well coverage of the formation filed is used. Tanks and reservoirs containing complex organic solvent and additional chemical agents are placed at the surface near the wells. The size of the tanks and/or reservoirs is sufficient to contain the amount of solvent and other chemical agents enough for concurrent processing of all production and injection wells or portion of the wells at the formation field, which are put into operation during development of the first formation chain. The tanks/reservoirs are filled with the solvent and chemical agents, which have an extended storage period, preferably not less than 3 years, and which can be used in a wide range of temperatures below and above freezing point. In some embodiments, one tank serves several neighboring wells and provides them with the complex organic solvent and chemical agents via pumps by pipes. When it is necessary to maintain predetermined levels of oil and gas production, the process of treating formation layers via all production wells using the complex organic solvent is repeated a plurality of times with necessary time intervals and carried out in a specific order and arrangement with concurrent killing of all injection wells to displace oil from the formation layers towards the production wells.

The specific order and arrangement required for this process is determined based either on opportunity to evenly treat bottomhole zones of the formation layers with the complex organic solvent, from the production wells at particular layer sites, or in several wells, or, when complicated geological conditions for oil and gas layers location are present, for example, in case of breaks in layer continuity, by multiple systems of crack weakening planes, overlaps, discarding and fusion of layers would result in layer treatment sequence and order, necessary under conditions described herein, suggesting maximum influence effect on layers with minimum time and expenses to be spent.

Multiple layer treatment is especially efficient for extraction of high viscosity oil fields, as well as for gas extraction from waterlogged wells with low layer natural pressure, or after intensive processing of gas fields, when inside-layer pressure within the layer decreases substantially, and gas wells may be run over with water incoming from layers with the gas, and the gas is not filtered through water filling the cracks and pores on the way to the wells. In such cases, in order to carry out gas production out of fields with high water content while treating the bottomhole zones, the density of the complex organic solvent is made maximum, while the viscosity is kept minimum, such that it can be pumped into the bottomhole zones of formation layers under predetermined pressures that are maximum possible pressures for the specified mining and geological conditions without breaking continuity and destroying layer structure, to displace layer waters from sand-clay and other kinds of gas-carrying rock layers, such as, for example, chalk-stone, marls, aleurolites, and slates layers, lowering their water content while increasing strength characteristics and pore pressure of the rock layers and preventing wide-scale outflow of sand, clay and other rocky particles from the formation layers into the bottomhole zones by incoming flow of gas and other fluids, which causes formation of plugs in the wells and breakdown of extraction equipment. In accordance with the present invention, gas penetrates, without obstacles, through the complex organic solvent and out of cracks and pores in the gas containing layers, which have been cleaned from various sediments (for example, salts and very small rock particles deposited by the formation layer waters), into the wells, unlike conditions wherein the cracks and pores or wells are filled with the formation layer waters, which prevent gas and gas condensates from advancing through them.

In some embodiments, the multiple wells treatment in also used for ordinary formation layer conditions, because with passage of time, cracks and pores through which oil and gas flow from formation layer into wells are blocked by asphalt, tar and paraffin deposits contained in oil, and mineral salts deposits mixed with small rock particles contained in the formation layer waters. Moreover, the tension rearrangement process in the bottomhole zones of layers also influences the closures of cracks and pores in the formation layers due to geostatic pressure. This process is very intensive near zones under wells influence, wherein a natural hydrostatic tension of intact rock formations is broken due to drilling of wells therein and further influence on the layers during extraction of oil and gas from the formation. The influence of geostatic pressure ultimately results in closure of cracks and pores, even if they are artificially created under very high pressures by hydraulic fracturing with breaking of layer continuity and destruction of layer structure, and then filled with propant or other crack filling fluids to prevent their closure. The treatment of bottomhole zones of the formation layers with complex organic solvent with a predetermined maximum density and minimum viscosity under maximum possible pump-in pressures determined for given mining and geological conditions of the oil field development, without breaking the continuity of rock layers and destroying the layer structure, allows for changing of tension-deformed state of rock layers, decreases tensions near wells and facilitates larger opening of natural cracks and pores, which makes it possible to clean them from the asphalt, tar and paraffin deposits and salt deposits mixed with small rock particles more efficiently. Due to this fact, injectability of the rock layers is increased within the injection wells, and it is possible to displace oil from the layers towards the production wells more efficiently. It also facilitates displacement of water from the gas containing formation layers, which prevents gas filtration from the layers.

Wells located within layers processing influence zone are freed of high pressure influence of mountain rocks, which rearrange themselves dozens of meters deep into layers, and cracks and pores are cleaned from sediments to enlarge them. Under concurrent layers treatment via all wells, the tension-deformed state of rock layers in zones of production and injection wells influence at entire oil field is changed, and total inflow of oil and gas in wells is increased.

For production wells killing during repair works with concurrent treatment of bottomhole zones in the formation layers, the density of the complex organic solvent is set to maximum and its viscosity is selected according to fracturing of oil and gas layers in particular areas of the oil fields, taking into account that columns of the complex organic solvent in the wells preserve their height when the density of the solvent is at its maximum, thus preventing, via pressure exerted by the weight of the solvent column, the flow of oil and other fluids from layers into the wells due to inside layers pressures. Upon completion of repair of the wells, the viscosity of the solvent is reduced by adding corresponding chemical agents up to the value wherein the complex organic solvent in the wells, influenced by its own weight, is filtered into the formation layers at low speed, and then, upon pumping of the solvent into the wells and creation of increased pressure in the well, a speed of solvent filtration into the bottomhole zones increases to dissolve asphalt, tar and paraffin deposits in terrigenous rocks, wherein organic acids present in the complex solvent dissolve calcium and magnesium salts present in carbonate rock formations, wherein injectability of formation layers during killing of the injection wells is increased and inflow of formation waters into the production wells is decreased due to hydrophobization of surfaces of cracks, pores, and capillaries in the formations and displacement of formation waters deeper into the formation layers and water layers during the treatment of bottomhole zones.

Due to chemical agents and organic acids included in the complex organic solvent, a protective hydrophobic film is formed on the treatment surface of the formation layers, which prevents asphalt, tar and paraffin deposits from forming and prevents the layer waters from penetrating into cracks and pores of rock layers. The higher a pore pressure of oil, gas and other formation fluids under particular conditions of the formation fields, the higher should be the column height of the complex organic solvent during the killing of the production wells during repair works period with the maximum possible density of the solvent.

Providing steady operation of extraction wells and timely and producible cleaning of the pipes from the asphalt, tar and paraffin deposits in upper portions thereof, while with low surface temperatures the complex organic solvent viscosity and density are reduced to minimum values for multiple pumping through the pipes from bottoms of wells on the surface into tanks or other reservoirs and backwards, in a cycle. The solvent in the bottoms of wells is heating under such circulation upon layers temperature at a depth of their bedding and is rapidly pumping through the pipes upwards and by means of such heating more quickly dissolve the asphalt, tar and paraffin deposits in pipes in upper portions of wells under low surface temperatures. Currently, for oil and gas layers mining depths reached, which vary at the average within the range 1.5 km to 6 km, the temperature above water freezing point at a depth of layers bedding in average may change between 70 and 200 degrees Celsius. In the tanks on the surface taking place is the process of originated mixture segregation by density and chilling point, and more dense complex organic solvent with lower chilling point, below 60 degrees Celsius, is set into tanks bottom and other reservoirs and is pumped in wells for reusing, and the lighter asphalt-resin-paraffin sediments are set in the upper portions of tanks, chill under low surface temperatures and then are cleaned off from the tanks via special devices, i.e., chain conveyers with dippers, or otherwise, for utilization. Anticorrosion agents, as phosphates, with proportions specified, are added into complex organic solvent, to repeatedly cover the oilfield equipment and pipes with protecting anticorrosion coating during repeated treatment of the bottomhole zones of layers, cleaning pipes from the asphalt-resin-paraffin sediments, in a cycle, and killing of the injection wells.

The bottomhole zones of the formation layers are treated with complex organic solvent from all of the production wells at the oil fields multiple times and repeated with necessary time intervals, which are determined by practice and in various oil fields vary depending on oil properties and mining and geological conditions. Thus, oil and gas production level required at the oil fields is maintained, and production process continuity is facilitated. The amount of complex organic solvent being pumped into wells varies with physical and chemical properties of oil, mining and geological conditions of oil and gas layers bedding and field production technological conditions, presence or absence of multilayer systems and their mutual influence, water bearing layers and horizons, significant breaks in layer continuity and fracture systems at the oil fields.

To reduce the amount of complex organic solvent pumped into injection wells and to make the oil and gas fields development more efficient and less costly, volumes of solvent to be pumped therein, to displace oil towards the production weds, and volumes of layer waters to be pumped thereafter are interlaced with the ratio from 1:1, at the beginning of pumping towards, minimum, 1:20 at the end of pumping, while increasing the total volume of the composition being pumped. The complex organic solvent with a maximum density and a minimum viscosity coming first at the beginning of pumping into layers through injection wells cleans the cracks and pores from the asphalt, tar and paraffin deposits and salts, and increases injectability of layers and, thus facilitates penetration of the layer waters into layers, which later penetrate into cracks and pores and clean off sediments. Then, the next portions of complex organic solvent not mixed with oilfield water are pumped into the wells, thus additionally cleaning cracks and pores of remaining asphalt, tar and paraffin deposits and salts and sediment that may reside after layer waters advance, thus, preventing injectability of layers from decreasing, and facilitating displacement of oil out of even larger area, leaving no unprocessed zones and rock pillars in layers, resulting in the most efficient and optimized displacement of oil from layers into the production wells. The process of displacement of oil from layers may be considered completed upon appearance in the production wells of the oil fields first portions of complex organic solvent marked in a particular way and discovered in the production wells according to samples selection results.

DETAILED DESCRIPTION OF THE INVENTION

Figure 1:
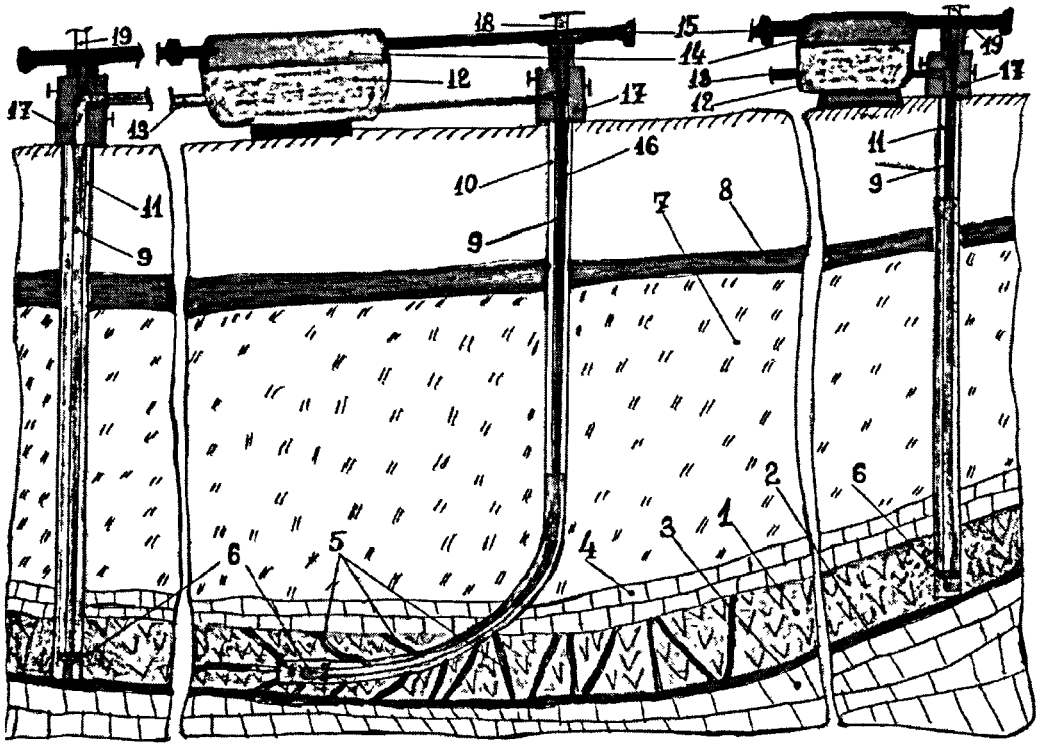
FIG. 1 is a schematic view for implementing a method of the present invention to increase oils, gas condensates and gas production out of fields, and to facilitate a steady operation of extraction and injection wells.

FIG. 1 illustrates a mountain rocks array with an exemplary embodiment of the method for locating an extraction horizontal well 10 and two injection wells 11, drilled at oil and gas layer 1, built by terrigenous sediments, to displace viscous oil therefrom towards extraction well 10. While drilling from surface through mountain rocks array 7, water-bearing horizon 8, clay rock roof 4 encasing layer 1, the wells are drilled not to reach the level of underlying layer waters 2, and soil clay rock 3, encasing the layer. The horizontal extraction well 10 appears after drilling within the zone excessive fissuring with separate large cracks 5 within oil and gas layer 1 that communicate to underlying layer waters 2 from where the layer waters come to the extraction well 10 through layer 1 with viscous oil and gas, making their production out of layer more complicated, for it results in layer watering, decreasing strength characteristics of rocks under low pore pressure, outflow of small sandy, clayey and other rock particles into horizontal well and exceeding water income during extraction. To increase production under more complicated mining and geological conditions herein (presence of system of large cracks in layer rocks and low pore pressure) to treat near-mine zone of exaction well 10 and oil displaced from layer 1 through injection wells 11 towards extraction well 10 with complex organic solvent with adjustable viscosity and density to be used as operating fluid. Thus, to kill injection wells and displace oil out of layer, the density of the working fluid is set to maximum, while its viscosity should be minimum. The same requirements are to be fulfilled also during treatment of the bottomhole zones of layers of the production wells under normal conditions, not aggravated by systems of large cracks, low pore pressure, geological discontinuity of layer rocks, and other factors influencing negatively the normal operation of extraction wells. Yet for the situation illustrated at the scheme of FIG. 1 under aggravated operational conditions during oil and gas extraction, for killing the extraction well 10 during its repair works in case of underground water blowout from water bearing horizon 8, with concurrent treating near-oil layer zone 1 under conditions of exceeding layer fracturing and large cracks 5 communicating with underlying the layer water 2, the complex organic solvent density is set to maximum, and its viscosity is selected according to oil and gas layers rock 1 fracturing on particular area of oil field taking into account that complex organic solvent column, emerged over bottoms of wells, with maximum density preserve their height thus preventing via pressure by their own weight incoming oil flow and other fluids from layer into well due to inside layers pressures existing on this area of oil field, and upon completion of well repair works its viscosity therein is reduced via adding corresponding chemical agents up to the value, when complex organic solvent in well influenced first by solvent column own weight, slowly taking long time and with viscosity being decreased, is filtered into layer 1 at low speed, to treat small cracks and pores at the maximum area possible leaving no untreated layer spots, and then during injections to create extra pressure within wells penetrates deeper into near-mine zone of layer 1 with acceleration to dissolve within 4-7 hours the asphalt-resin-paraffin as well as salt sediments due to organic acids, presented in complex solvent within small and larger cracks and pores. Herein, significantly decreased is intensity of paraffin, resins and asphaltene sediments upon the surfaces of cracks and pores decreasing layer waters inflow during further operation of the well, due to hydrophobization of surfaces of cracks, pores, capillaries (the surface thereof forms protecting hydrophobic coating that is regularly maintained and renewed at multiple layer treatments) and superseding layer waters deep into layer 1 and underlying water-bearing slice 2 while treating near-mine zone of layer 1 with complex organic solvent.

Upon surface of oil and gas field developed, to facilitate above-mentioned operations to implement the method, tanks or reservoirs 12 are installed to supply wells and regenerate after repeated use the complex organic solvent and to separate it from asphalt-resin-paraffin sediments (ARPS). Due to the difference in density and in crystallization temperature of the solvent and ARPS in tanks or reservoirs, their surface gains the slice ARPS 14, separated from the solvent. This slice of ARPS 14 is later removed from the reservoirs via specialized devices 15 for removing ARPS from tanks or reservoirs, for instance, implemented as chain conveyers with dippers, moving along reservoir surface or any other devices.

To dean upper portions of pipes in wells off ARPS 16 that reduces pipe useful section and prevents oils advance therein under low surface temperatures, the viscosity and density of complex organic solvent are decreased to minimum values for its multiple pumping through pipes from bottoms of wells to the surface in tanks or other reservoirs and back in a cycle upon the above-mentioned operations the ARPS dissolved within pipes also remain in tanks or reservoirs within the superficial slice ARPS 14. New portions of complex organic solvent are supplied to reservoirs via pipelines 13, to be later directed towards extraction or injection wells via pumping and compressor pipes (PCP) 9 by near-well deep-seated sinking pumps 6, flush and shutoff valves on well mouths 17, while oil and gas taken from layers are supplied via pipelines 18 towards preparation node for further transportation from the field towards main pipeline. Pipelines 19 are configured to supply injection wells 11 with layer water, for using them to interchange it with particular volumes of complex organic solvent pumped therein.

Figure 2:
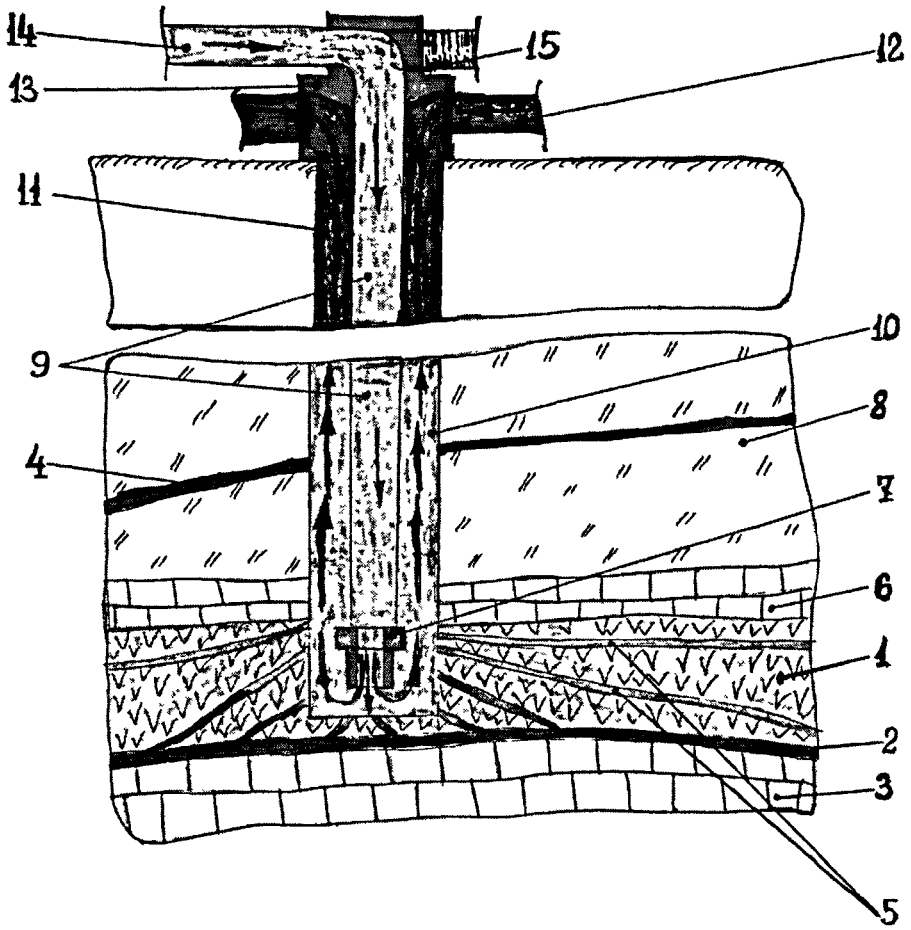
FIG. 2 is a schematic view of the method for changing viscosity and density of complex organic solvent by adding corresponding chemical agents into wells, as well as supplying new portions for regeneration and refilling the complex organic solvent used earlier to treat near-mine zones of layers of exaction wells.

Upon completing repair works in extraction wells with simultaneous layer treatment the viscosity of complex organic solvent is reduced by means of adding into wells the corresponding chemical agents to facilitate efficient completion near-mine zones of layers treatment followed by increasing pressures during solvent injection into layers. FIG. 2 illustrates implementation scheme for this operation in more details. A vertical well that is drilled to the oil and gas layer 1 through mountain rock array 8, water-bearing horizon 4, clay rock roof 6 encasing the layer, via pumping and compressor pipe 14 is provided from below with one third part of corresponding chemical agents from tanks or reservoirs upon surface to reduce viscosity of complex organic solvent upon completing repair assisted by near-well deep-seated sinking pump 7. The repair was carried out to eliminate underground water break-in into the well from the water-bearing horizon 4. Oil and gas layer 1, after geological discontinuity taking place during its formation has large cracks 5 communicating with its underlying water-bearing slice 2, located below which are soil clay rock 3, encasing the layer. For the period of repair works the extraction well was killed with complex organic solvent with the predetermined maximum density and viscosity selected according to rock fracturing and presence of large cracks 5 in layer 1 taking into account that solvent column, emerged over bottom of well, with maximum density preserve its height, would not penetrate large cracks thus preventing via pressure by their own weight incoming oil flow and other fluids from layers into the well creating the pressure by solvent column own weight exceeding in-layer oil, gas and water pressure via predetermined unchanged solvent column height in the well.

To time-optimize the transition from complex organic solvent maximum viscosity with the maximum density, when used during well repair, to kill the well, towards minimum viscosity that is necessary to continue the near-mine zone of layer treatment upon repair completion, additional chemical agents are supplied to the well with the following quantitative ratio: one third part is supplied via the pump and compressor pipes 14 to the well 10 by deep-seated sinking pump 7 upwards, while the remaining two thirds come through the pipe 12 directly through the tank downwards. New portions of complex organic solvent are supplied via the pipe 11 to recover the solvent used earlier to treat the bottomhole zone of layer 1. The complex organic solvent may be used many times if recovered every time for 15-20%. Upon completion of the near-mine zone of layer treatment in connection with repairing the vertical extraction well, there is no need to clean and shake the well after the repair, wasting time and money on it. Oil debit from the well rises right after the repair work with simultaneous layer treatment.

After near-mine zones of layers treatment in carbonate rocks the complex organic solvent makes calcium and magnesium salts soluble due to the organic acids presented therein. To facilitate extraction and injection wells steady operation, the complex organic solvent is provided with anticorrosion add-ons, as phosphates, with proportions specified, for multiple covering with protecting anticorrosion coating the oilfield equipment and pipes during multiply treating near-mine zones of layers, cleaning pipes off the asphalt-resin-paraffin sediments, in a cycle, and injection wells killing.

Concurrent influence is possible on oil and gas layers at particular area via several wells, or multiple wells, or even via all the wells operating at the field. The method discussed suggests that together with treating all near-mine zones of layers, from all extracting wells at the oil fields all the injection wells are killed by complex organic solvent with increasing layers injectivity and superseding oils towards extraction wells leaving no untreated spots in layers due to favorable operational conditions after multiple layers treatments and efficient oil superseding thereof.

To get lasting effect after treating near-mine zones and superseding oils from layers using complex organic solvent to maintain the level of oil and gas production therein, layers are multiple treated through the wells with necessary time intervals, order and sequence. Herein formed around extraction wells are areas that are treated with solvent, with open and clean of sediments cracks and pores that start intensive supplying of oils and gases with simplified penetration into extraction wells due to constant multiple layers treatment with internals surfaces thereof hydrophobization. Those sequence and time intervals for treating the layers through the extraction wells are selected depending on particular conditions at the fields, layers rocks fracturing and displacement and are to be specified experimentally, and due to different conditions at different fields the parameters may vary substantially.

Thus, the method proposed facilitates efficient, technologically advanced, and alternating with intensive production of oils, gas condensates and gases from fields, process of treating near-mine zones of layers by complex organic solvent with changing viscosity and density depending on particular conditions and fracturing factor of layer rocks from the extraction wells, together with displacement of oil, by the solvent, from the layers through the injection well without leaving untreated spots in layers to provide for steady operation of the production wells even during the repair period, due to simultaneous treatment of their bottomhole zones, with multiple anti-corrosion treatment of pipes and industrial equipment, cleaning pipes in the upper portions of the wells with solvent to get rid of the asphaltene, resins and paraffin sediments under low surface temperatures, in a cycle, with layer waters being displaced from the gas-carrying layers, its watering reduction and preventing wide-scale rock particle outflow onto the bottoms of wells with rock plugs formation resulting in wells equipment failure. Implementing the method comprising the operations discussed would result in more complete mineral resources extraction from fields and gives substantial economic benefit.

What is claimed is:

1. A method for increasing the extraction of oil, gas condensates and gas from deposits and for ensuring continuous operation of production and injection wells, comprising the steps of pumping working fluids into production and injection wells bored in deposits to treat bottomhole zones and to displace oil from formations, repairing the wells, subjecting pipes and equipment disposed in the wells to anti-corrosion treatment, and in the event of low surface temperatures, cleaning pipes in upper parts of the production wells of asphalt, tar and paraffin deposits, wherein the working fluid used is a complex organic solvent with variable viscosity and density, and wherein the bottomhole zones of formations in the production wells are treated and the injection wells are killed and oil is displaced from the formations in the direction of the production wells by using said solvent, wherein the density of said solvent is set at maximum and the viscosity of said solvent is set at minimum, and wherein the production wells are killed during repair with concurrent treatment of the bottomhole zones of the formations by using said solvent, wherein the density of the solvent is set at maximum and the viscosity of said solvent is selection based on degree of fracturing of the rock layers such that height of the complex organic solvent columns created in the wells remains constant and pressure of the columns prevents oil and other formation fluids from entering the wells due to inside layer pressures, wherein, upon completion of repair of the wells, a viscosity of the solvent is reduced by adding corresponding chemical agents until it reaches a value at which the complex organic solvent begins to filter into the formation layers at low speed due to the pressure in the solvent, and then, upon pumping of the solvent into the wells and creation of increased pressure in the well, a speed of solvent filtration into the bottomhole zones increases to dissolve asphalt, tar and paraffin deposits in terrigenous rocks, wherein organic acids present in the complex solvent dissolve calcium and magnesium salts present in carbonate rock formations, wherein injectability of formation layers during killing of the injection wells is increased and inflow of formation waters into the production wells is decreased due to hydrophobization of surfaces of cracks, pores, and capillaries in the formations and displacement of formation waters deeper into the formation layers and water layers during the treatment of bottomhole zones, wherein, in low surface temperature conditions, the pipes in upper portions of production wells are cleaned from asphalt, tar and paraffin deposits by reducing viscosity and density of the complex organic solvent to minimum values and by recirculating the solvent between bottoms of the wells and solvent reservoirs positioned on the surface, wherein the step of treatment of bottomhole zones of the production wells is repeated multiple times with necessary time intervals to maintain production levels of oil and gas from the formations, wherein anti-corrosion agents such as phosphates are added to the complex organic solvent in specified proportions and mining equipment and pipes are repeatedly covered with an anti-corrosion layer during repeated treatment of bottomhole zones, cleaning of pipes from asphalt, tar and paraffin deposits by recirculating the solvent and killing of the injection wells, wherein, in order to extract gas from formation layers having high water content, density of the complex organic solvent is increased to a maximum and viscosity is decreased to a minimum, and the solvent is pumped into the bottomhole zones under a maximum pressure possible for specified mining and geological conditions without breaking continuity of rock formation and destroying layer structure to displace water from clay-sand and other kinds of gas-carrying formation layers to decrease their water content, while increasing strength characteristics and pore pressure of the rock layers and preventing wide-scale outflow of sand, clay and other rocky particles from the formation layers into the bottomhole zones by incoming flow of gas and other fluids, which causes formation of plugs in the wells and breakdown of extraction equipment.

2. The method of claim 1, wherein the treatment of bottomhole zones of all production wells at the formation is performed concurrently with killing of all injection wells by using the complex organic solvent, wherein the density of the solvent is increased to a maximum and the viscosity of the solvent is decreased to a minimum, wherein cracks and pores in the formation layers are cleaned from asphalt, tar and paraffin deposits and salt deposits by dissolving salty sediments by dissolving them and increasing injectability of the formation layers, wherein maximum possible pump-in pressures of the complex organic solvent are set under given mining and geological conditions of the field development without fracturing of subsurface rock layers and destroying their structure, wherein oil is displaced towards the production wells, wherein alternating volumes of the complex organic solvent and formation layer waters are pumped into the injection wells in a ratio from about 1:1 at the beginning of pumping to about 1:20 at the end of pumping, based on increasing total volume of the composition pumped.

3. The method of claim 1, wherein the amount of the complex organic solvent being pumped into the wells is adjusted depending on physical-chemical properties of oil, mining and geological conditions of oil and gas formation layers and technological conditions formation field development.

* * * * *